US006076474A

United States Patent [19]

Grabowski et al.

[11] Patent Number: 6,076,474

[45] Date of Patent: Jun. 20, 2000

[54] FREESTANDING FURNITURE SYSTEM

[75] Inventors: Daniel Grabowski, Grand Rapids; Randall P. Nelsen, Alto; Jonathan J. King, East Grand Rapids; Michael H. Abson, Lowell; Roy W. Fink, Portage; Michelle R. Gallette, Lake Orion, all of Mich.

[73] Assignee: Steelcase Inc., Grand Rapids, Mich.

[21] Appl. No.: 09/018,247

[22] Filed: Feb. 3, 1998

[51] Int. Cl.[7] ..... A47B 83/00

[52] U.S. Cl. ..... 108/50.02; 312/196; 108/60

[58] Field of Search ..... 108/50.02, 101, 108/60; 312/223.3, 223.6, 265.6, 196, 265.4, 223.1, 107, 198, 195; 52/36.1, 36.2, 36.4, 36.6

[56] References Cited

U.S. PATENT DOCUMENTS

| | | | |
|---|---|---|---|
| 291,134 | 1/1884 | Beach . | |
| 1,715,983 | 6/1929 | Brandt . | |
| 2,566,954 | 9/1951 | Murray | 312/203 |
| 2,694,614 | 11/1954 | Dent | 312/196 |
| 2,821,450 | 1/1958 | Knoll | 312/111 |
| 2,897,030 | 7/1959 | Ficarella | 311/16.5 |
| 2,903,316 | 9/1959 | Schmidt | 312/253 |
| 2,930,665 | 3/1960 | Budai | 312/111 |
| 2,942,924 | 6/1960 | Stangert | 312/140.4 |
| 2,944,861 | 7/1960 | Lessin | 312/196 |
| 3,326,147 | 6/1967 | Toney | 108/27 |
| 3,361,090 | 1/1968 | Howlett | 108/33 |
| 3,485,189 | 12/1969 | Marco | 108/64 |
| 3,786,765 | 1/1974 | Burr | 108/60 |
| 4,029,024 | 6/1977 | Klitzky | 108/60 |
| 4,035,093 | 7/1977 | Redshaw | 403/4 |
| 4,044,694 | 8/1977 | Wylie | 108/28 |
| 4,050,752 | 9/1977 | Dykstra | 312/195 |
| 4,116,509 | 9/1978 | Smith | 312/257 R |
| 4,272,136 | 6/1981 | Sengua | 312/196 |
| 4,586,759 | 5/1986 | Wrobel | 312/198 |
| 4,619,486 | 10/1986 | Hannah et al. | 312/195 |
| 4,685,255 | 8/1987 | Kelley | 52/36 |
| 4,883,330 | 11/1989 | Armstrong et al. | 312/195 |
| 4,914,873 | 4/1990 | Newhouse | 52/36 |

(List continued on next page.)

*Primary Examiner*—Peter M. Cuomo
*Assistant Examiner*—Jerry A. Anderson
*Attorney, Agent, or Firm*—Price Heneveld Cooper Dewitt & Litton

[57] ABSTRACT

A freestanding support for supporting a worksurface and an overhead storage unit and the like in an open office environment includes at least three legs where each leg has a bottom portion adapted for resting on a floor, a top horizontal support adapted for receiving and supporting a worksurface on the support, and a vertical support which maintains the bottom portion and the top horizontal support in a fixed vertically spaced relationship. A stretcher extends between and is attached to an upper rear portion of the end legs thereby maintaining the two end legs in a parallel horizontally disposed relationship. The freestanding support also has at least two support posts. One support post has an intermediate portion attached to the stretcher and is positioned substantially in alignment with one of the end legs and further has a bottom portion attached to the vertical support of the end leg. At least a second additional support post has an intermediate portion attached to the stretcher in alignment with the intermediate leg and has a bottom portion attached to the vertical support of the intermediate leg. Each support post has an upper end which is adapted to support a portion of an overhead storage unit above the worksurface supported by the top horizontal supports. The intermediate positioning of one of the support posts and the intermediate leg permits the incorporation of an overhead storage unit with a given worksurface having a different length than the overhead storage unit.

21 Claims, 11 Drawing Sheets

U.S. PATENT DOCUMENTS

| | | | |
|---|---|---|---|
| 4,986,194 | 1/1991 | Bollman | 108/111 |
| 5,016,405 | 5/1991 | Lee | 52/36 |
| 5,024,167 | 6/1991 | Hayward | 312/195 |
| 5,092,253 | 3/1992 | Grund et al. | 108/101 |
| 5,094,174 | 3/1992 | Grund et al. | 108/50 |
| 5,103,741 | 4/1992 | Grund et al. | 108/50 |
| 5,182,996 | 2/1993 | Gutgsell | 108/64 |
| 5,183,319 | 2/1993 | Pearson et al. | 312/196 |
| 5,220,871 | 6/1993 | Grund et al. | 108/50 |
| 5,241,796 | 9/1993 | Hellwig et al. | 52/36.4 |
| 5,255,966 | 10/1993 | Newhouse et al. | 312/107 |
| 5,341,749 | 8/1994 | Noakes | 108/64 |
| 5,346,296 | 9/1994 | Kelley | 312/198 |
| 5,394,658 | 3/1995 | Schreiner et al. | 52/36.1 |
| 5,428,928 | 7/1995 | Hellwig et al. | 52/239 |
| 5,451,101 | 9/1995 | Ellison et al. | 312/223.6 |
| 5,486,041 | 1/1996 | Sykes | 312/111 |
| 5,544,593 | 8/1996 | Canfield et al. | 108/50 |
| 5,588,376 | 12/1996 | Seidl et al. | 108/106 |
| 5,601,037 | 2/1997 | Meyer et al. | 108/147 |
| 5,606,920 | 3/1997 | Meyer et al. | 108/50 |
| 5,609,112 | 3/1997 | Meyer et al. | 108/153 |
| 5,833,332 | 11/1998 | Marshall et al. | 312/223.6 |

FREESTANDING FURNITURE SYSTEM

BACKGROUND OF THE INVENTION

The present invention relates to office workstations, and in particular to freestanding support structures for office workstation worksurfaces.

Open office plans are well-known in the art, and generally comprise large, open floor spaces in buildings that are furnished in a manner that is readily reconfigurable to accommodate the ever changing needs of a specific user, as well as the divergent requirements of different tenants. One arrangement commonly used for furnishing open plans includes movable partition panels that are detachably interconnected to partition off the open spaces into individual workstations or offices. Such partition panels are configured to receive hang-on furniture units, such as worksurfaces, overhead cabinets, shelves, etc., and are generally known in the office furniture industry as "Systems Furniture." Another arrangement for dividing or partitioning open plans includes modular furniture arrangements, in which a plurality of differently shaped, freestanding furniture units are interconnected in a side-by-side relationship, with upstanding privacy screens attached to at least some of the furniture units to create individual, distinct workstations, or offices.

Conventional, built-in offices and conference rooms are typically expensive to construct and maintain, and are not usually considered an efficient use of space in open plan environments. When such conventional rooms are constructed in rented office space, they become permanent leasehold improvements, which must be depreciated over a lengthy time period, and cannot be readily moved upon the expiration of the lease. The reconfiguration of such spaces is quite messy, and very disruptive to conducting day-to-day business. Furthermore, even the use of prior art partitioning arrangements results in disruption of day-to-day business, since dividing panels of such systems are often shared between adjacent workstations. Additionally, the prior art partitioning systems also require that the worksurfaces and storage units utilized therein be of a particular configuration and size for mounting on the partition panels. Such size is dictated by the individual panel lengths utilized in constructing the workstation, and any desired change to larger or smaller units typically also requires the reconfiguration of the partitioning panels thus further disrupting the occupants of adjacent workstations.

Efficient use of building floor space is also an ever growing concern, particularly as building costs continue to escalate. Many types of highly trained workers, such as engineers, accountants, computer programmers, and the like, are now being supported in open office settings, instead of conventional private offices in order to gain increased efficiency of real estate and life cycle costs. These professional workers require a combination of privacy and efficiency of available work space to accomplish the increasing demands of their respective professions. Thus, it is important to provide such highly skilled workers with furnishings that can establish a proper balance between worker privacy, worker interaction, while still employing the efficiency of an open office plan and provide for ready and easy reconfigurability with a minimum disruption to adjacent workstations.

SUMMARY OF THE INVENTION

One aspect of the present invention is a freestanding support for supporting a worksurface and an overhead storage unit and the like in an open office environment. The freestanding support includes at least three legs where each leg has a bottom portion adapted for resting on a floor, a top horizontal support adapted for receiving and supporting a worksurface on the support, and a vertical support which maintains the bottom portion and the top horizontal support in a fixed vertically spaced relationship. The vertical support includes a rear edge which has a plurality of vertically aligned holes in a predefined regularly spaced pattern. At least two of the legs are end legs and at least one of the legs is an intermediate leg positioned between the end legs. A stretcher has one end attached to an upper portion of one of the rear edges of an end leg and the other end attached to an upper portion of the other end leg thereby maintaining the two end legs in a parallel horizontally disposed relationship. The stretcher has a rear face and a plurality of horizontally aligned holes along the rear face in a predefined regularly spaced pattern. The freestanding support also has at least two support posts. One support post is positioned substantially in alignment with one of the end legs and further has a bottom portion attached to at least one of the vertically aligned holes in the vertical support of the end leg. At least a second additional support post is in alignment with the intermediate leg and has a bottom portion attached to at least one of the vertically aligned holes in the vertical support of the intermediate leg. Each support post has an upper end which is adapted to support a portion of an overhead storage unit above the worksurface supported by the top horizontal supports. The intermediate positioning of one of the support posts and the intermediate leg permits the incorporation of an overhead storage unit with a given worksurface having a different length than the overhead storage unit.

Yet another aspect of the present invention is a freestanding support system for supporting a plurality of worksurfaces and overhead storage units and the like in an open office environment and for dividing the open office environment into a plurality of workstations. The freestanding support system includes a plurality of legs wherein each leg has a bottom portion adapted for resting on a floor, a top horizontal support adapted for receiving at least a portion of one of the worksurfaces, and a vertical support maintaining the bottom portion and the top horizontal support in a fixed vertically spaced relationship. The vertical support includes a rear edge having a plurality of vertically aligning holes along its vertical length in a predefined regularly spaced pattern. At least two of the legs are end legs and at least one of the legs is an intermediate leg positioned between the two end legs. The support system also includes a plurality of stretchers, each stretcher having each end attached to an upper portion of one of the rear edges of one of the plurality of legs. Each stretcher maintaining at least two of the legs in a parallel horizontally disposed relationship. Each stretcher has along a rear face a plurality of horizontally aligned holes which are arranged in a predefined regularly spaced pattern. There are at least two support posts. Each of a first and a second is substantially in alignment with one of the legs and has a bottom portion attached to at least one of the vertically aligned holes in the vertical support of the leg to which it is aligned. Each of the support posts has an upper end adapted to support a portion of an overhead storage unit above the worksurfaces and permits the incorporation of an overhead storage unit with a given worksurface of a different length.

Still another aspect of the present invention is a freestanding workstation for use in an open office environment and for dividing the open office environment into a plurality of workstations. The freestanding workstation includes a plurality of legs. Each leg has a bottom portion adapted for resting on a floor, a top horizontal support, and a vertical support maintaining the foot and the top horizontal support in a fixed vertically spaced relationship. The vertical support also has a rear edge having a plurality of vertically aligned holes therealong in a predefined regularly spaced pattern. At least two of the legs are end legs and at least one of the legs is an intermediate leg positioned between the two end legs. A plurality of stretchers are attached to the legs, each stretcher having each of its ends attached to an upper portion of the rear edge of a leg maintaining at least two of the legs in a parallel, horizontally disposed relationship. Each stretcher also has on a rear face a plurality of horizontally aligned holes in a predefined regularly spaced pattern. A plurality of worksurfaces are attached to the top horizontal supports of the legs and each of the worksurfaces has a top, a bottom, a first and a second end, and a rear edge. A plurality of modesty panels are attached to the rear surface of the stretchers, each modesty panel attached to one stretcher. Each modesty panel extends vertically from the top horizontal support to above feet of the legs and extends substantially horizontally from a first of the legs supporting one end of a worksurface to a second of the legs supporting a second end of the worksurface. Each modesty panel is substantially of equal length as the worksurface and has an exterior face which defines an outer surface of the freestanding workstation. The outer surface of the workstation is abuttable to an outer surface of a like freestanding workstation.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
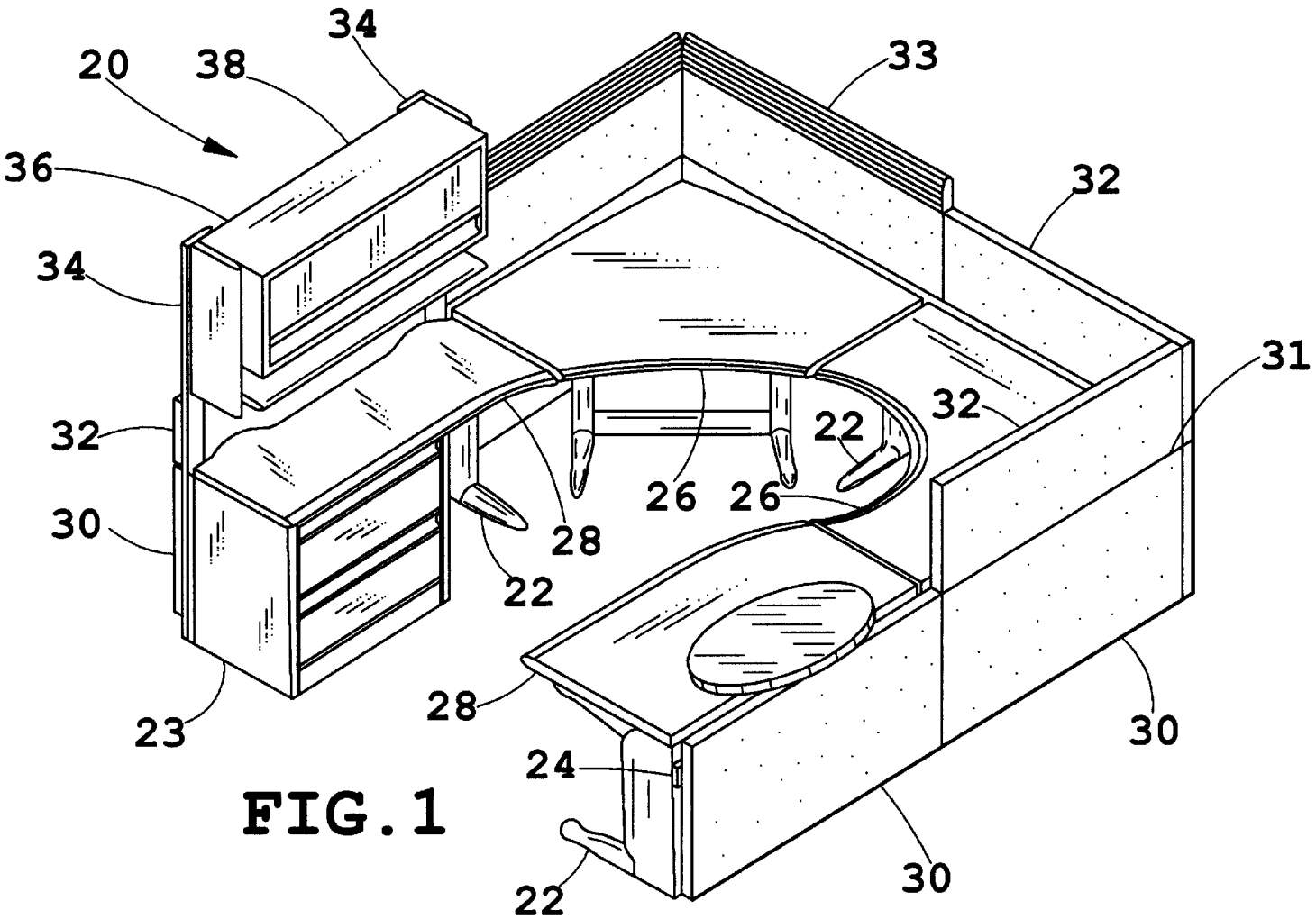
FIG. 1 is a perspective view of a workstation embodying the support structure of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Turning to the drawings, FIG. 1 shows a workstation 20, which is one of the preferred embodiments of the present invention, and illustrates its various components.

Workstation 20, as seen in FIG. 1, includes a plurality of legs 22 which are interconnected in a vertically parallel upstanding fashion by stretchers 24 attached to a rear portion of legs 22. While legs 22 and stretchers 24 may be interconnected to form a variety of configurations, workstation 20 shows a combination thereof as a rectilinear workstation having one end open for ingress and egress by a user. Modesty panels 30 are attached to stretchers 24 around a periphery of workstation 20 and privacy panels 32 can be added to an upper edge 31 of modesty panels 30 to provide the user of workstation 20 with some degree of privacy and isolation in an open office area. Additionally, translucent panels 33 can be added to the top of privacy panels 32 in like manner or directly to modesty panels 30. The embodiment of workstation 20 also includes support posts 34 attached to the rear portion of legs 22 and extending above worksurfaces 26 and 28 to facilitate the support of an overhead storage unit 36. Overhead storage unit 36 can be configured either as a closable bin (not shown) or as a plurality of shelves 38. One or more legs 22 can be eliminated and have substituted therefore a pedestal storage unit 23. Pedestal storage unit 23 is configured in such a manner as to facilitate the attachment of stretchers 24 and support posts 34 thereto.

Figure 2:
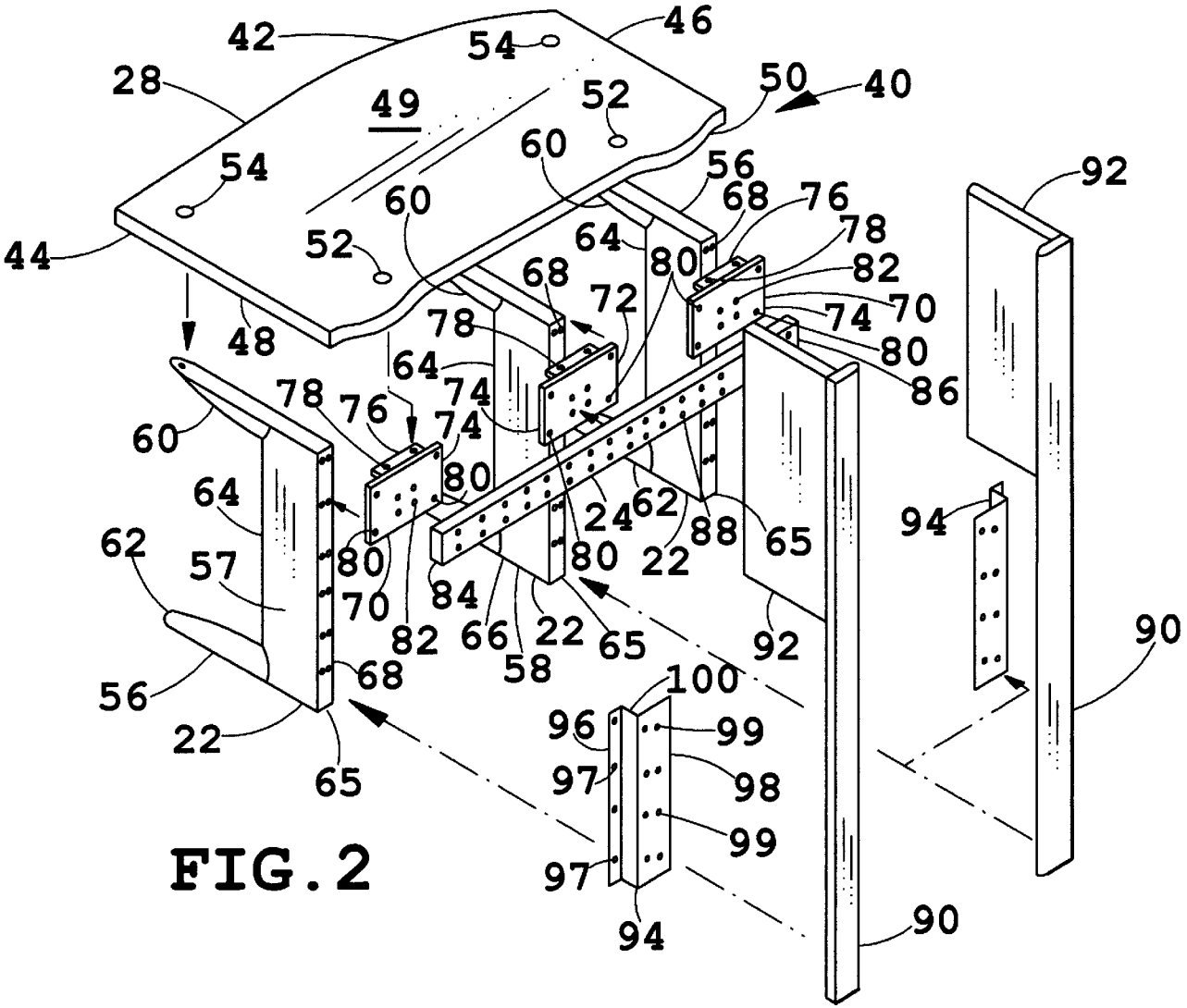
FIG. 2 is an exploded rear perspective view of the support structure shown in FIG. 1 wherein support posts are configured to mount an overhead storage bin of a shorter length than the worksurface.

Referring now to FIG. 2, a single unit freestanding workstation 40 is shown in an exploded view illustrating the elements and construction of workstation 40. Workstation 40 is configured to support a linear worksurface 28. Worksurface 28 has a front edge 42 which can be contoured to facilitate ease of access and use by the worker. Worksurface 28 also has first and second ends 44 and 46 and a rear edge 50. Rear edge 50, in the preferred embodiment, is contoured to facilitate and partially define a utility wiring trough more fully described below. Worksurface 28 also has a generally parallel planar bottom and top surfaces 48 and 49, respectively, with rear mounting holes 52 and front mounting holes 54 at least partially therethrough for the securing of the worksurface 28 to legs 22 of the support structure.

As shown, workstation 40 includes at least three legs 22, two legs being end legs 56 and one leg being intermediate leg 58, each end leg 56 has a horizontal top support 60 and a forward extending foot 62 to maintain workstation 40 in an upright position. Top horizontal support 60 and foot 62 are maintained in a fixed vertically disposed relationship by vertical support 64. Intermediate leg 58 also has a horizontal top support 60 and a vertical support 64 substantially identical to end legs 56. However, bottom portion 66 of intermediate leg 58 does not extend horizontally forward from the bottom of vertical support 64. Foot 62 of end legs 56 function to provide vertical stability to workstation 40. Each vertical support 64 has a rear edge 65 which has therein a vertical pattern of holes 68. Vertical pattern of holes 68 in the preferred embodiment are arranged in a side-by-side pattern of two identical rows of equally vertically spaced holes 68.

Attached to an upper end of rear edge 65 of each leg 22 is either an end gusset 70 or an intermediate gusset 72. Each of gussets 70 and 72 are comprised of a vertical plate 74 having a top horizontal flange 76 extending from a top edge of plate 74. Flange 76 has at least one hole 78 therethrough which upon assembly of the freestanding support structure is substantially in registration with at least one rear mount hole 52 of worksurface 28. Mount plate 74 has at each end thereof mount holes 80 which are vertically spaced substantially the same as holes 68 in rear edge 65 of vertical support 64 in such a manner to permit fastening of gussets 70 and 72 to the upper portion of rear edge 65 of vertical supports 64. A second set of mount holes 82 are located substantially in a central portion of vertical mount plate 74. The configuration pattern of holes 82 generally correspond to holes 88 in stretcher 24 as described below.

Stretcher 24 is substantially of identical length to worksurface 28 such that first end 84 is coplanar with first end 44 of worksurface 28 and second end 86 of stretcher 24 is coplanar with second end 46 of worksurface 28. Stretcher 24 has a plurality of holes 88 arranged in a predefined regularly spaced horizontal pattern. In the preferred embodiment, holes 88 have a horizontal spacing of three inches. However, alternative hole spacings can be utilized to facilitate the mounting of accessories thereto having incremental length differences other than three inches while not departing from the intent of this disclosure.

In assembly, gussets 70 and 72 are fastened to legs 22 utilizing standard fasteners (not shown) such that holes 80 at an end of vertical mount plate 74 are in registration with upper holes 68 in rear edge 65 of vertical support 64 of legs 22. Stretcher 24 is attached to gussets 70 and 72 utilizing fasteners (not shown) through holes 88 of stretcher 24 and holes 82 of vertical mount plate 74. The lateral spacing between holes 80 and holes 82 in vertical mount plate 74 of end gussets 70 is sized to position outer face 57 of end legs 56 substantially coplanar to end edges 44 and 46 of worksurface 28 when the workstation is configured as a single unit workstation 40. Alternatively, the horizontal spacing of holes 80 and 82 in vertical mount plate 74 can be increased to laterally displace end legs 56 with respect to ends 44 and 46 of worksurface 28 such that either or both of first and second ends 44 and 46 of worksurface 28 are coincident with a vertical plane substantially bisecting end legs 56. Such a shift of end legs 56 thereby permit a single leg such as end leg 56 to support another end of an adjacent worksurface (not shown). Such a lateral shift of end leg 56 permits one leg 56 to be used at a lateral abutment of two worksurfaces for the support of one end of both worksurfaces. The use of one leg 56 to support abutting ends of adjacent worksurfaces 28 facilitates lower cost, ease of assembly, and a minimization of the complexity of the assembly process. The utilization of alternately sized gussets 70 and 72 for the mounting of stretcher 24 to legs 22 results in maintaining stretcher 24 in a fixed lateral relationship with worksurface 28 while permitting end legs 56 to be configured either in a sole-supporting or a shared-supporting configuration.

Workstation 40 can also include an overhead storage unit (not shown) supported above worksurface 28. Such an overhead storage unit is supported by support posts 90 which have at an upper end, end blades 92 to which the overhead storage unit or individual shelves may be affixed. In office furniture systems as currently known, overhead storage units are typically of an equal length as worksurface 28 such that each end of the overhead storage unit is supported by a support post positioned substantially coincident with the plane of end legs 56. In the preferred embodiment of freestanding workstation 40, one support post 90 is positioned substantially coincident with one end leg 56 and the other support post 90 is positioned substantially coincident with intermediate leg 58. The horizontal spacing of support posts 90 is governed by the length of the overhead storage unit to be supported thereby and by the horizontal spacing of holes 88 in stretcher 24. The horizontal spacing of holes 88 in stretcher 24 being governed by the incremental size differences in overhead storage units to be potentially supported by support posts 90. The function of intermediate leg 58 facilitates the support of support post 90 in a desired fixed relationship to worksurface 28 and end legs 56 to facilitate the mounting of an overhead storage unit thereby.

Support posts 90 are affixed to the rear edge 65 of vertical supports 64 of legs 22 using post brackets 94. Each post bracket 94 has a first flange 96 having a plurality of vertically aligned and regularly spaced holes 97 therethrough. The pattern of holes 97 corresponds to the vertical spaced hole pattern of holes 68 in rear edge 65 of legs 22. Post bracket 94 also has a second flange 98 spaced from first flange 96 by web 100 and has a plurality of mount holes 99 therethrough for the attachment of posts 90 to flange 98. Web 100 is sized to correspond with the thickness of stretcher 24 to facilitate the support of support posts 90 in a vertical configuration. Rear edge 50 of worksurface 28 is contoured in such a manner as to permit the lateral positioning of one or both support posts 90 therealong at positions other than at an end of worksurface 28. While FIG. 2 illustrates the positioning of support posts 90 wherein one is coincident with an end of worksurface 28, a second intermediate leg can be added whereby both support posts 90 are positioned intermediate to end legs 56 according to the desires of the user and the length of the overhead storage unit to be supported.

The lateral positioning of holes 97 with respect to holes 99 in post bracket 94 can be adjusted to facilitate the alternate positioning of leg 56 as a shared leg between adjacent and abutting worksurfaces in a manner similar to adjusting the lateral spacing between holes 80 and 82 in end gussets 70.

Figure 3:
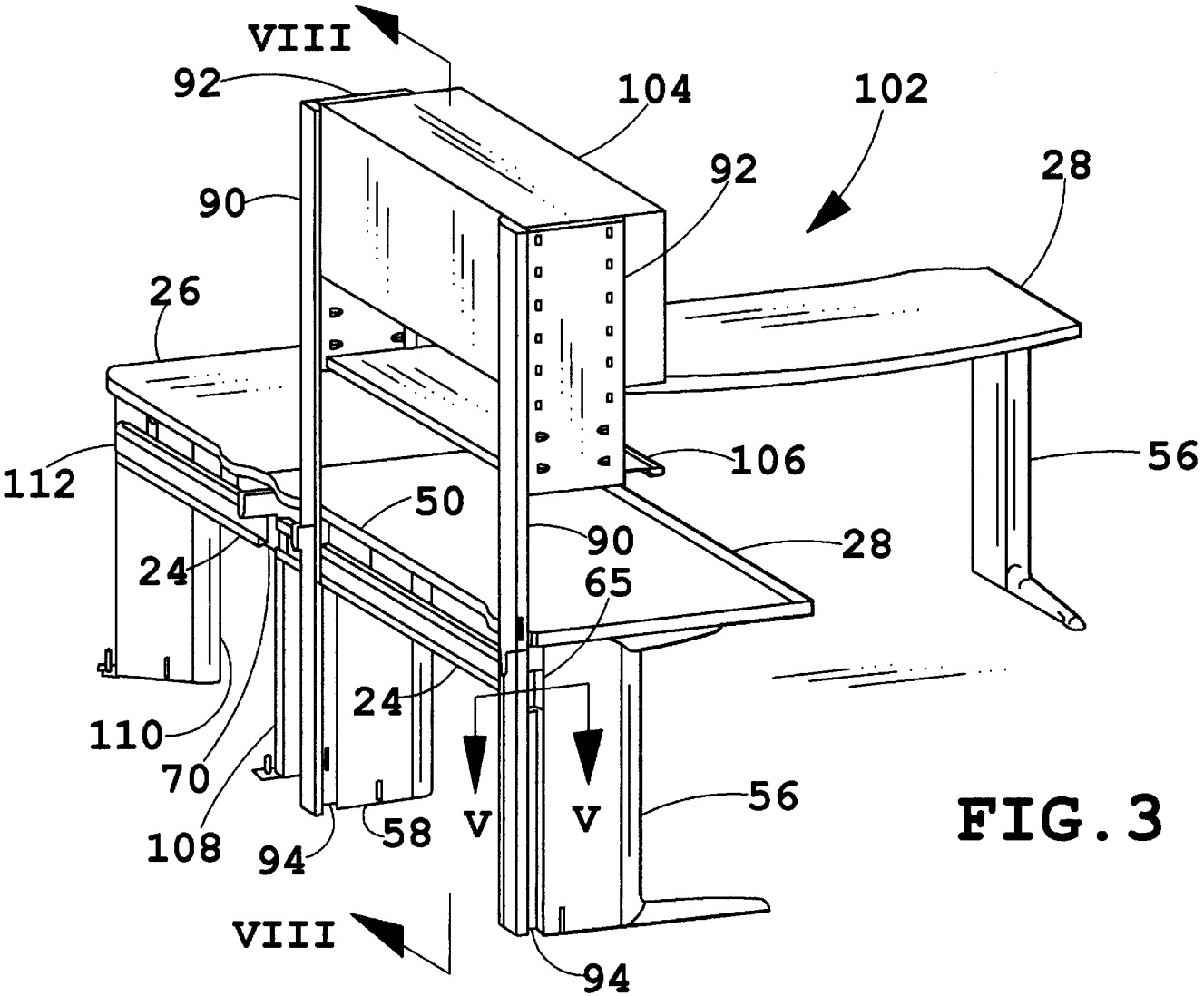
FIG. 3 is a rear perspective view of the support posts attached to the support structure supporting an overhead storage unit shorter than the worksurface.

As shown in FIG. 3, an L-shaped workstation is shown in rear perspective as an alternate embodiment to the single unit workstation of FIG. 2. Workstation 102 of FIG. 3 shows linear worksurfaces 28 supported by end legs 56 and each abutted to an end of corner worksurface 26. Each worksurface has a stretcher 24 extending between and attached to the rear edge 65 of each legs 56, 58, and 108. A support post 90 is attached to the lower portion of rear edge 65 of one of end legs 56 with post bracket 94 at one end of one of worksurface 28 and also shows an intermediate leg 58 to which the other support post 90 is attached in like manner. Support posts 90 each have an end blade 92 to which is attached storage bin 104 and shelf 106. Each storage bin 104 and shelf 106 are of a shorter length than worksurface 28. Rear edge 50 of worksurface 28 is shown as being contoured to facilitate the addition of support posts 90.

Corner worksurface 26 abutted to linear worksurface 28 shares leg 108 to which is also mounted a second stretcher 24 extending to corner leg 110. Corner leg 110 is typically oriented at a 45° angle to the other legs for optimum support of corner worksurface element 26. One end of stretcher 24 is attached to corner leg 110 with gusset 112. Gusset 112 can be formed in a manner such that its vertical mount plate 74 has a side flange formed at an angle to plate 74 to facilitate the attachment to rear edge 65 of corner leg 110. A second linear worksurface 28 is abutted to a second end of corner worksurface 26 sharing with it a leg such as shared leg 108 and having an opposite end supported by an other end leg 56 as before described.

Figure 4:
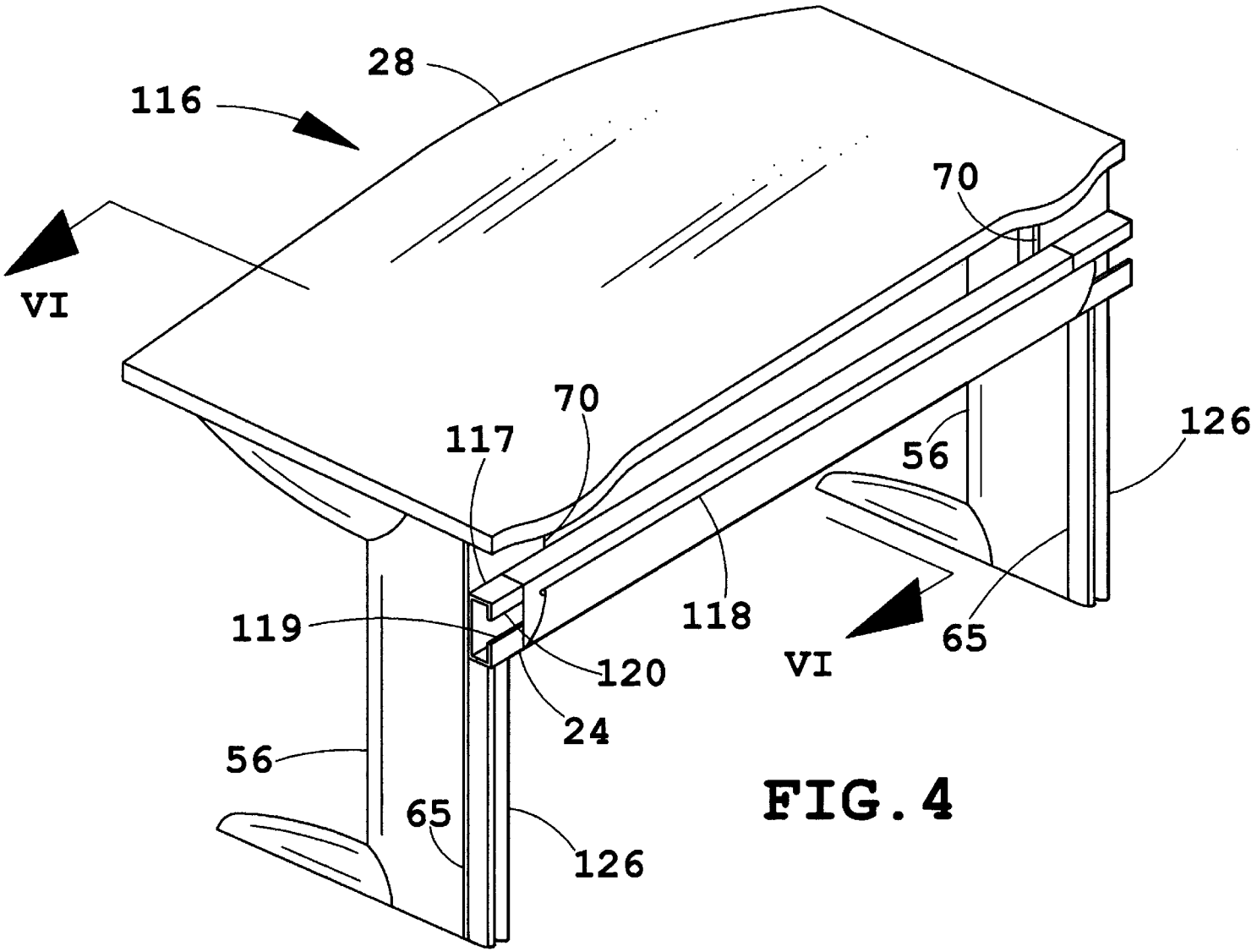
FIG. 4 is a rear perspective view of a cable routing trough mounted to the support structure stretcher for the routing of office utility tables.
Figure 15:
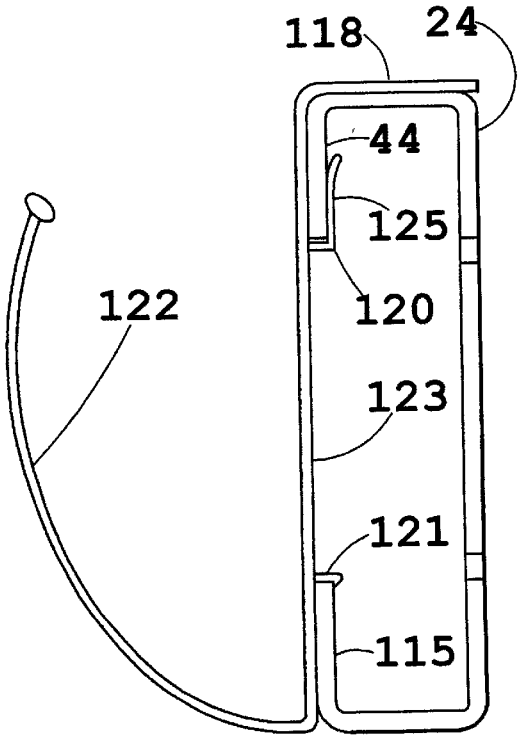
FIG. 15 is an end elevational view taken at XV of FIG. 6 of the cable routing trough attached to a stretcher.

Referring now to FIGS. 4 and 15, another workstation embodiment 116 is illustrated whereby a linear worksurface 28 is supported at each end by end legs 56 and has a stretcher 24 attached to rear edge 65 of each leg 56 with end gussets 70. A cable routing trough 118 is mounted to stretcher 24. Cable routing rough 118 includes a vertical web 123 having extending from a bottom thereof a generally upwardly oriented concave cable cradle 122. Web 123 has extending from an opposite face vertically displaced and horizontally parallel legs 120 and 121. Legs 120 and 121 are spaced in a manner as to closely receive flanges 114 and 115 of stretcher 24. Upper leg 120 of trough 118 has an upwardly oriented finger 125 to positively capture flange 114 of stretcher 24. Each stretcher 24 typically has a cable trough 118 mounted on a rear side for the support of office utility cables.

Figure 5:
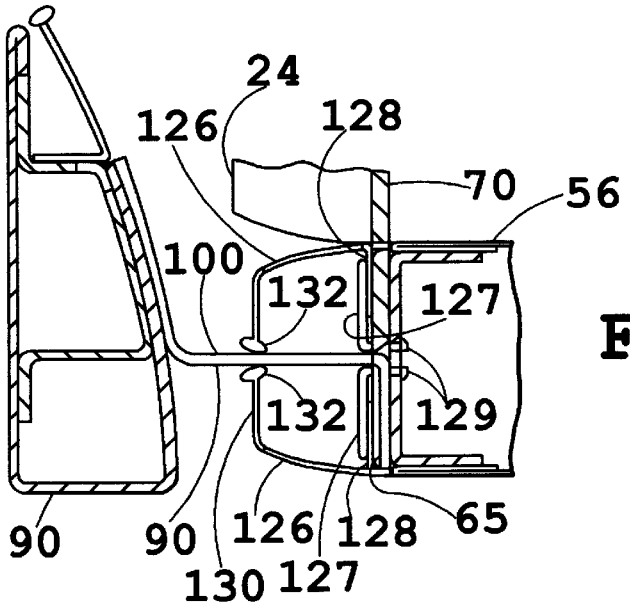
FIG. 5 is a top plan sectional view of a vertical cable channel and support post mounted to a rear edge of a support structure leg taken along the line V—V of FIG. 3.

Referring now to FIG. 5, a pair of cable channels 126 can be affixed to rear edge 65 of leg 56. Cable channel 126 is affixed to rear edge 65 using holes 68. Each cable channel 126 has a generally U-shape wherein a flange 128 abuts to rear edge 65 and maintains legs 130 in a spaced apart relationship and further wherein ends 132 of legs 130 are biased one toward the other for the retention of an office utility cable therein and for the routing of such a cable from a floor surface of the office to cable cradle 122 of cable routing trough 118. Cable channels 126 are typically fabricated from a molded or extruded resin such that legs 130 are resilient to allow the insertion of utility cables therebetween. A retainer clip 127 having fingers 129 inserted in rear edge 65 capture flanges 128 between clip 127 and rear edge 65 of leg 56 thereby retaining cable channels 126 to rear edge 65.

Figure 6:
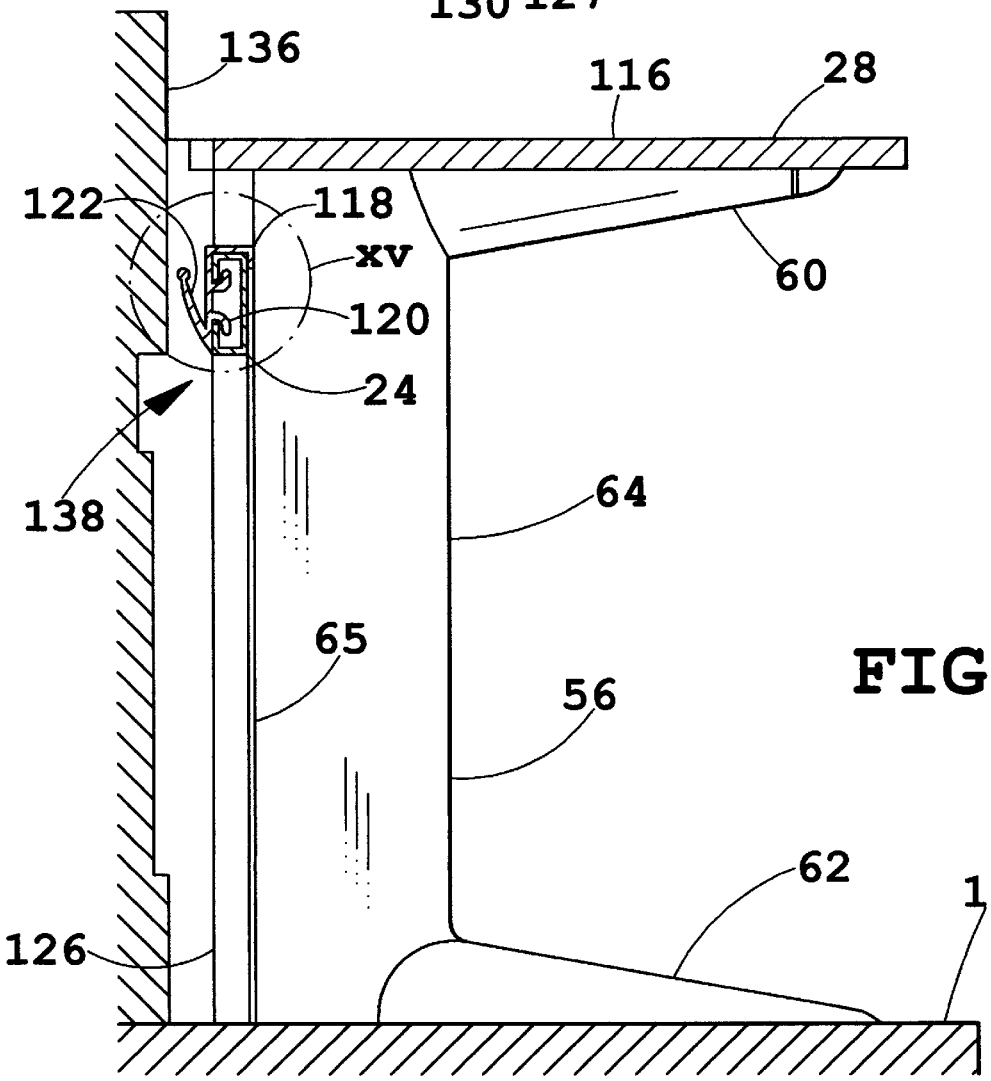
FIG. 6 is a side elevational view in partial section of a freestanding support structure according to the present invention shown in relationship to an office dividing panel taken along the line VI—VI of FIG. 4.

FIG. 6 illustrates workstation 116 of FIG. 4 in partial cross section and further shown in a freestanding relationship to an office dividing panel 136. Office dividing panel 136 can have therein a utility beltway 138 within which are routed office utility cables and further wherein one or more of the office utility cables can be broken out therefrom and routed to cable trough 118 for the additional routing of the office utility cables along workstation 116. Foot 62 is shown supported on floor 139 and vertical cable channel 126 is positioned to route office utility cables along rear edge 65 of leg 56 from floor 139 to cable trough 118.

Figure 7:
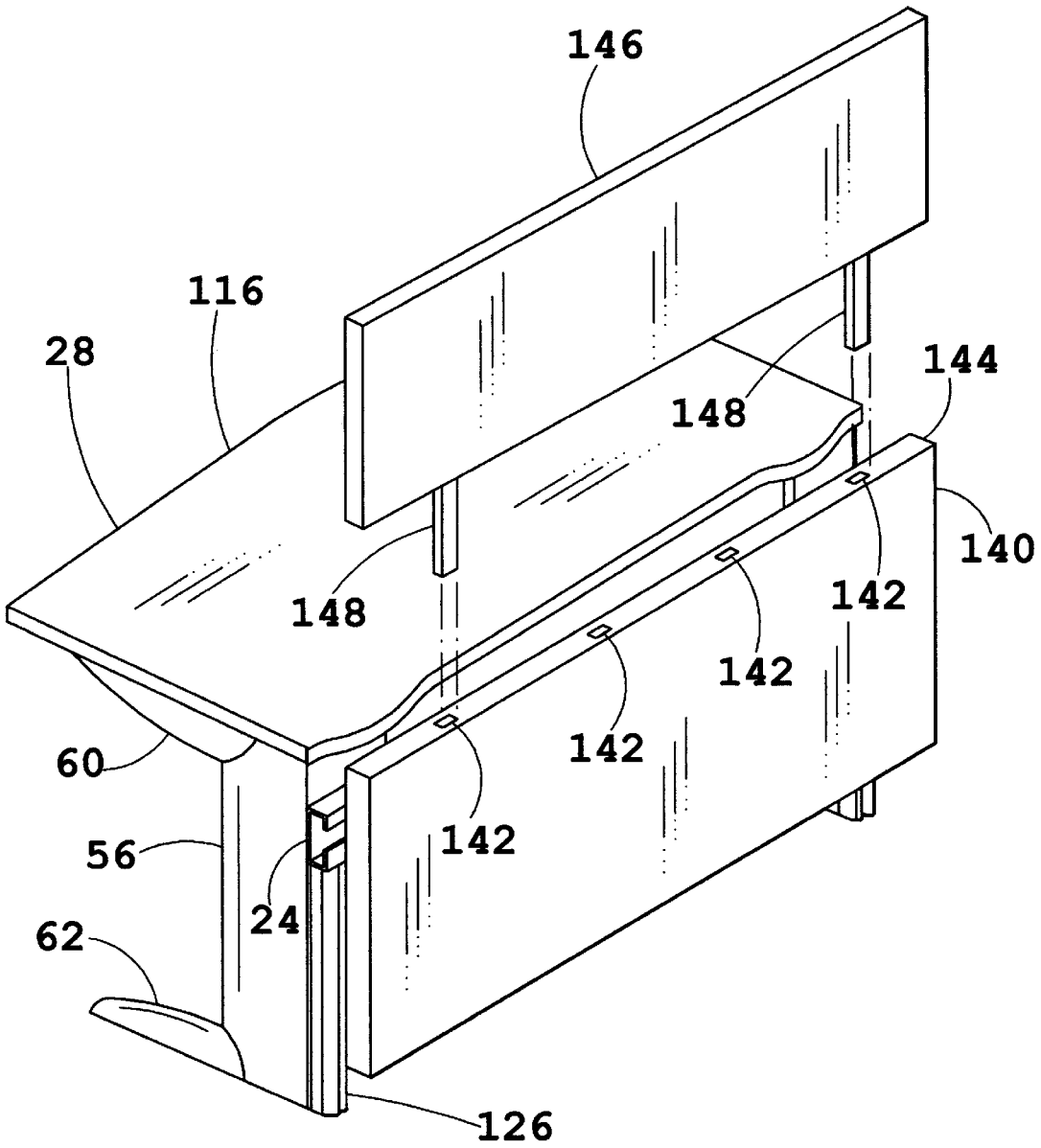
FIG. 7 is a rear perspective view of a freestanding support with a modesty panel and privacy screen attached to the stretcher of the support structure.

FIG. 7 shows workstation 116 wherein a modesty panel 140 is mounted to stretcher 24. Modesty panel 140 in the preferred embodiment extends substantially from the top of leg 56 downward and terminates above floor level and substantially extends laterally the length of stretcher 24 and worksurface 28. Modesty panel 140 can have a plurality of receiving holes 142 in a top edge 144. A privacy panel 146 has at least two support posts 148 depending therefrom wherein support posts 148 are telescopically received in receiving holes 142 to mount privacy panel on top edge 144 to provide privacy for the user of workstation 116. In the preferred embodiment, modesty panel 140 and privacy panel 146 are typically one inch thick.

Turning now to FIG. 8, workstation 116 is again shown in end elevation and partial cross section showing worksurface 28 partially supported by end leg 56 with stretcher 24 attached to the upper portion of leg 56 at rear edge 65. A cable trough 118 is shown mounted on stretcher 24. Vertical cable channel 126 extends below stretcher 24 along rear edge 65 of leg 56 to floor 139. Support post 90 is attached to leg 56 and stretcher 24 as hereinbefore described and extends above worksurface 28 to support shelf 106 between end blades 92. Modesty panel 140 is also mounted to stretcher 24 and has supporting on top edge 144 privacy panel 146. Rear edge 50 of worksurface 28 defines in combination with a front face 141 of modesty panel 140 a cable routing channel 148 therebetween which extends continuously around the outer periphery of workstation 116. Cable routing channel 148 facilitates the laying-in of office utility cables to rest on cable trough 118 mounted to stretcher 24.

Figure 8:
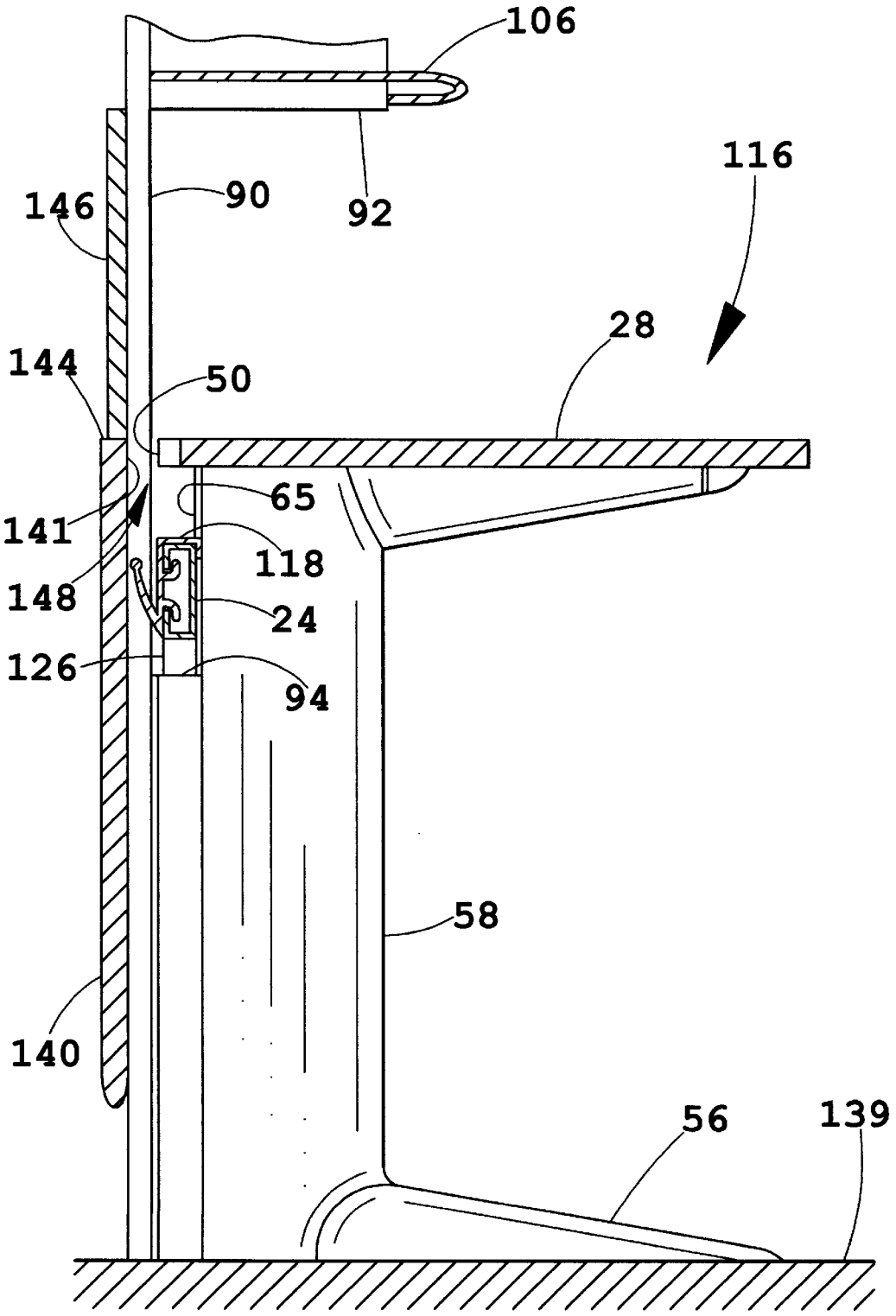
FIG. 8 is a side elevation in partial section taken along the line VIII—VIII of FIG. 3 and further incorporating the modesty panel and privacy screen of FIG. 7.
Figure 9:
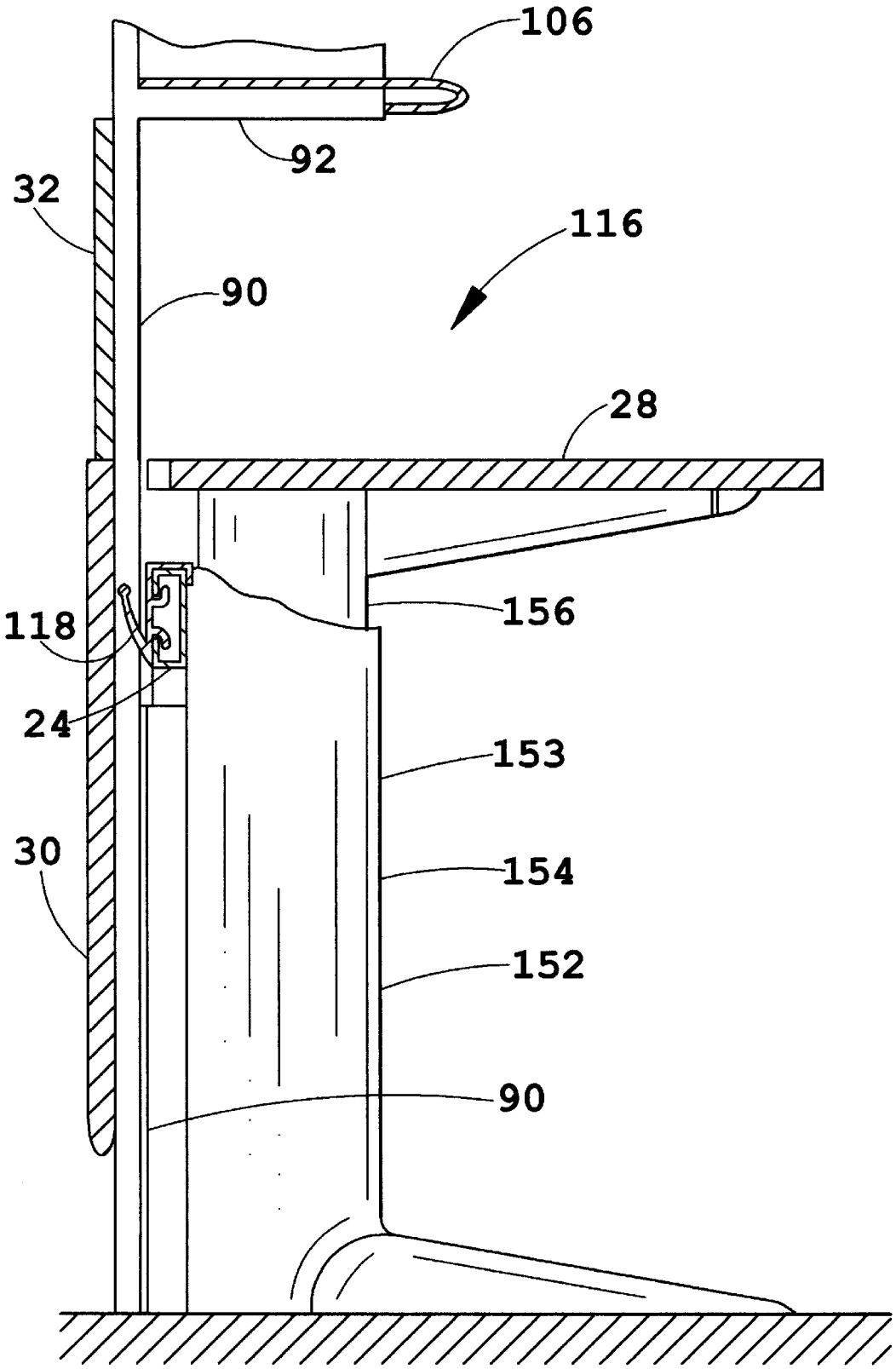
FIG. 9 shows a side elevation in partial section of the freestanding support of FIG. 8 incorporating a vertically adjustable leg.

FIG. 9 illustrates workstation 116 as configured in FIG. 8 except that leg 56 is replaced by adjustable leg 152. Adjustable leg 152 is similar in construction and function as leg 56 except the vertical support 64 of leg 56 is replaced by adjustable support 153 having a base segment 154 into which is received telescoping segment 156. Telescoping segment 156 can be vertically repositioned within base segment 154 in a manner which is well-known in the art. Stretcher 24 is mounted to base segment 154.

Figure 10:
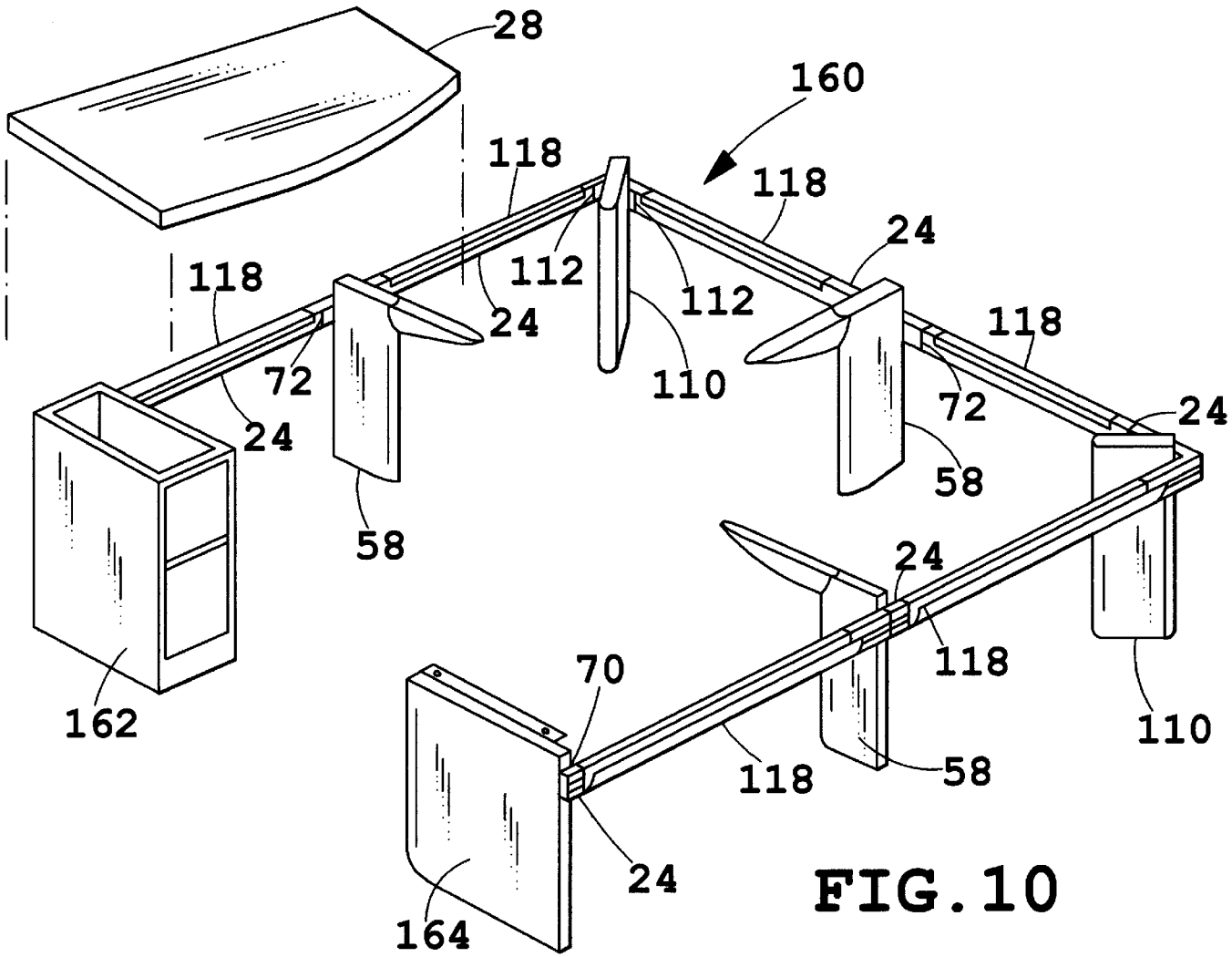
FIG. 10 shows one embodiment of the freestanding support system arranged to create a rectilinear workstation such as shown in FIG. 1.

Referring now to FIG. 10, a freestanding support structure 160 is shown forming the skeleton of a rectilinear workstation. One end of support structure 160 has a pedestal storage unit 162 supporting one end of a stretcher 24. The other end has an end panel 164 which functions in a manner similar to that of leg 56. End panel 164 is a solid panel to facilitate the aesthetics of support structure 160 and supports one end of a stretcher 24. Each end of stretchers 24 are supported by gussets 70, 72, or 112 attached to legs 56, 58, or 110 such that each leg 56, 58, or 110 supports both abutting ends of adjacent stretchers 24. Stretchers 24 also have affixed to the rear thereof cable troughs 118 to facilitate the routing of office utility cables around the periphery of a workstation constructed with support structure 160.

Figure 11:
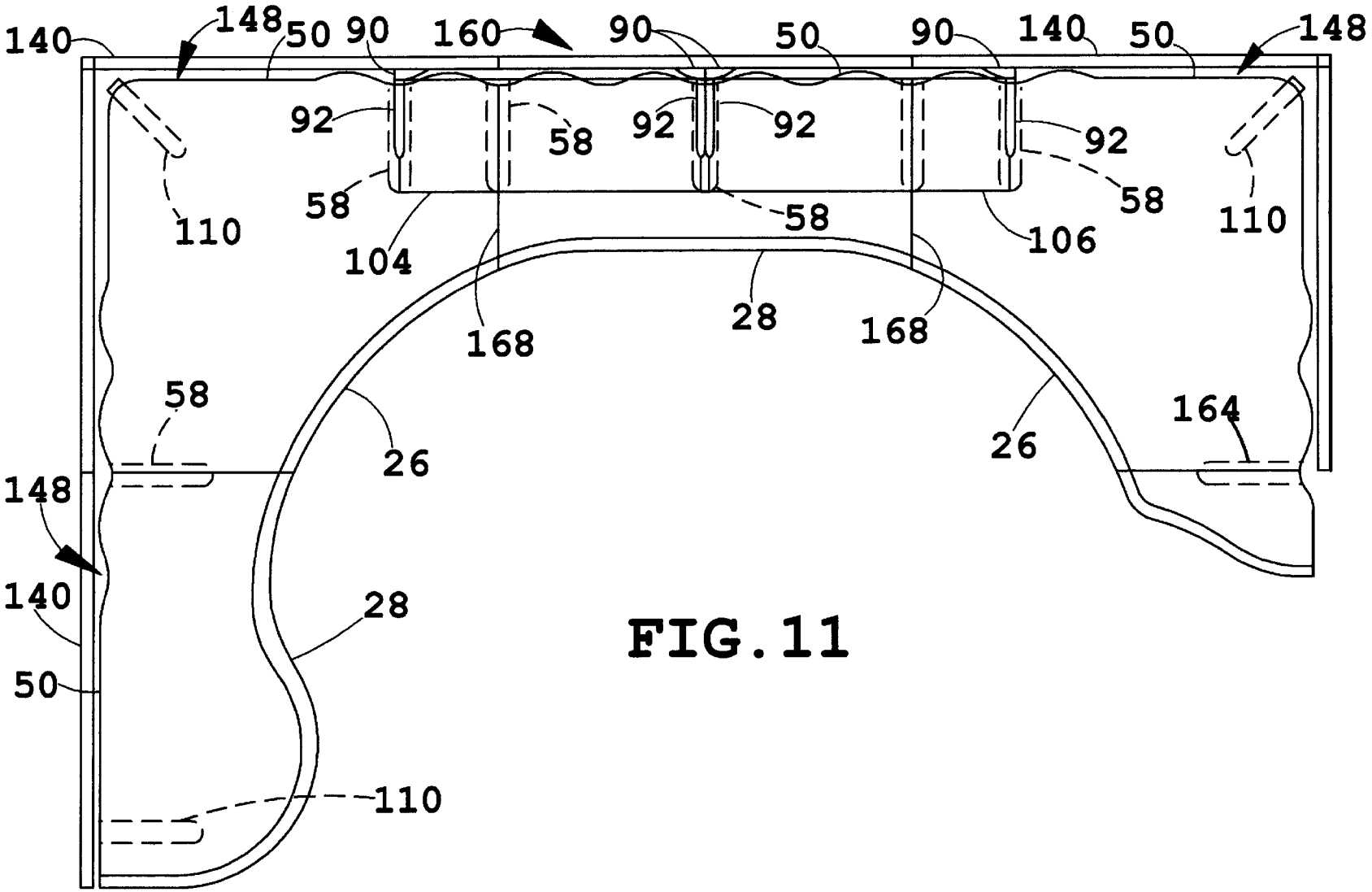
FIG. 11 is a plan view of a workstation incorporating an embodiment of the freestanding support system showing the support of overhead storage units wherein the ends of the storage units are not in registration with the ends of the worksurface elements.

FIG. 11 illustrates in top plan one embodiment of a workstation constructed in such a manner. Linear and corner worksurfaces 28 and 26, respectively, are supported by the assembled legs 58 and 110, pedestal 162, and end panel 164. Worksurfaces 26 and 28 have a contoured rear edge 50 which in combination with modesty panels 140 define cable routing channel 148 therebetween. Cable routing channel 148 extends continuously about the internal periphery of modesty panels 140 to facilitate the lay-in routing of office utility cables. Also shown are support posts 90 having blades 92 at an upper portion thereof to which are affixed and suspended therebetween storage bin 104 and shelf 106. As illustrated, support posts 90 are located along rear edge 50 of the worksurfaces and are not copositioned with the abutments 168 of worksurfaces 26 and 28, thus illustrating off-module positioning of the overhead storage units with respect to the worksurfaces over which they are positioned.

Figure 12:
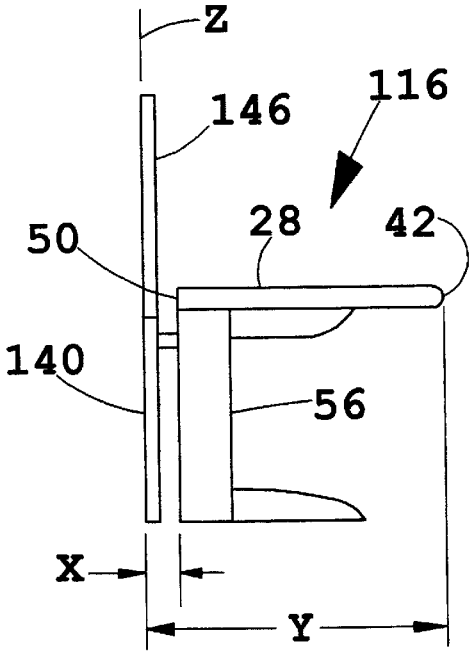
FIG. 12 is a representative side elevational view of the freestanding support system with a modesty panel and privacy panel attached to the rear thereof.
Figure 13:
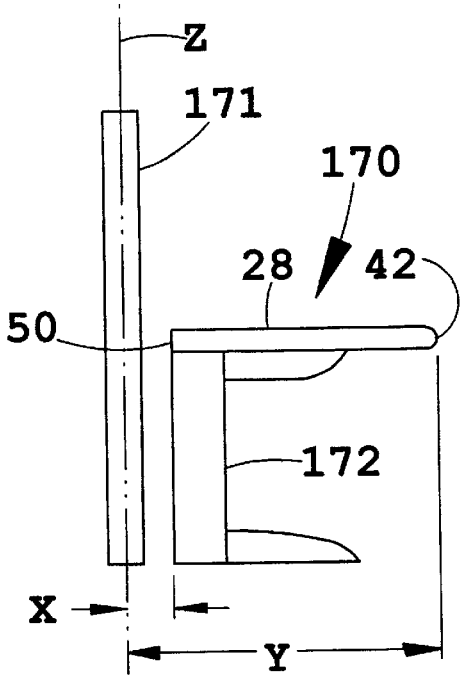
FIG. 13 shows a typical support system with respect to a two inch office dividing panel in combination with the worksurface of FIG. 12.
Figure 14:
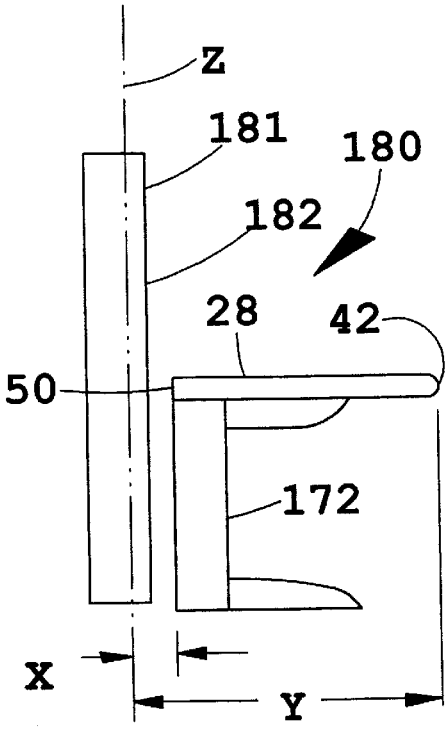
FIG. 14 is a side elevational view of a worksurface support with respect to a four inch office dividing panel in combination with the worksurface of FIG. 12.

Turning now to FIGS. 12–14, similar worksurface support structures supporting identical worksurfaces 28 are illustrated according to the preferred embodiment and in comparison with office dividing systems having office panels of different thicknesses. FIG. 12 illustrates the freestanding support structure 116 according to the preferred embodiment as described herein. FIG. 12 shows support structure 116 having a dimension X as measured from an external surface (plane Z) of modesty panel 140 to rear edge 50 of worksurface 28 and also having a corresponding dimension Y as measured from the plane Z to the front edge 42 of worksurface 28.

FIG. 13 illustrates a panel system 170 with worksurface 28 positioned with respect to an office dividing panel 171 and supported by fixed leg 172 wherein office dividing panel 171 is typically two inches thick. Plane Z bisects dividing panel 170 such that dimension X as measured from plane Z to rear edge 50 of worksurface 28 corresponds to dimension X of FIG. 12 and dimension Y from plane Z to front edge 42 of worksurface 28 corresponds to dimension Y of FIG. 12. Thus, the placement of two support structures 116 in a back-to-back relationship wherein plane Z of both structures 116 are coincident yields an identical dimensional relationship as an office system constructed with panel system 170 of FIG. 13 wherein a worksurface 28 is supported as herein described and positioned on both sides of dividing panel 171. Thus, it can be seen by those skilled in the art that a plurality of freestanding structures 116 can be intermixed in a typical office setting with office modules created with panel system 170 of FIG. 13 such that the overall planning dimensions of support systems 116 and panel system 170 are substantially identical. Identical nominal planning dimensions facilitate the intermixing of freestanding support systems 116 with panel dividing system 170.

FIG. 14 illustrates an office panel dividing system 180 having four inch thick dividing panels 181 such that the positioning of worksurface 28 supported by legs 172 as herein described such that dimension Y as measured from the forward edge 42 of worksurface 28 to plane Z substantially positions plane Z one inch from a face 182 of four inch panel 181. Thus, the incorporation of support system 116 as shown in FIG. 12 with dividing system 180 of FIG. 14 results in the same effect as the incorporation of identical worksurfaces 28 and legs 172 with two inch support panel system 170 of FIG. 13 with dividing system 180 of FIG. 14.

The identical dimensioned relationship of worksurfaces 28 to plane Z of each system as illustrated in FIGS. 12–14 facilitates the placement of freestanding workstations according to the preferred embodiment in work space modules constructed with office panel systems 170 and 180. The freestanding support structure according to the preferred embodiment without modesty panels 140 and privacy panels 146 can also be substituted in the office modules of dividing systems 170 and 180 in place of the fixed support structure utilizing fixed legs 172 and presenting to the user of the office module a substantially identical office workstation.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

The invention claimed is:

1. A freestanding support system for supporting a plurality of worksurfaces and overhead storage units and the like in an open office environment and for dividing the open office environment into a plurality of workstations, said freestanding support system comprising:

a plurality of legs, each leg having a bottom portion adapted for resting on a floor, a top horizontal support adapted for receiving thereon a portion of at least one of the worksurfaces, and a vertical support maintaining said bottom portion and said top horizontal support in a fixed vertically spaced relationship, said vertical support including a rear edge having a plurality of vertically aligned holes therealong in a predefined regularly spaced pattern, at least two of said legs are end legs and at least one of said legs is an intermediate leg positioned between said at least two end legs;

a plurality of stretchers, each stretcher having two ends, each of said ends attached to an upper portion of one of said end legs maintaining said end legs in a parallel, horizontally disposed relationship, said stretcher having in a rear face therealong a plurality of horizontally aligned holes therealong in a predefined regularly spaced pattern; and at least two support posts, a first support post substantially in alignment with a first of said legs and having a bottom portion attached to at least one of said vertically aligned holes in said vertical support of said leg, and at least a second support post substantially in alignment with a second of said legs and having a bottom portion attached to at least one of said vertically aligned holes in said vertical support of said second of said legs wherein one of said first and second legs is said intermediate leg, each said support post having an upper end adapted to support a portion of the overhead storage unit above the worksurfaces, thereby permitting the incorporation of an overhead storage unit with a given worksurface of a different length.

2. A freestanding support system for supporting a plurality of worksurfaces and overhead storage units and the like in an open office environment and for dividing the open office environment into a plurality of workstations, said freestanding support system comprising:

a plurality of legs, each leg having a bottom portion adapted for resting on a floor, a top horizontal support adapted for receiving thereon a portion of at least one of the worksurfaces, and a vertical support maintaining said bottom portion and said top horizontal support in a fixed vertically spaced relationship, said vertical support including a rear edge having a plurality of vertically aligned holes therealong in a predefined regularly spaced pattern, at least two of said legs are end legs and at least one of said legs is an intermediate leg positioned between said at least two end legs;

a plurality of stretchers, each stretcher having two ends, each of said ends attached to an upper portion of one of said rear edges maintaining at least two of said legs in a parallel, horizontally disposed relationship, said stretcher having in a rear face therealong a plurality of horizontally aligned holes therealong in a predefined regularly spaced pattern; and at least two support posts, a first support post substantially in alignment with a first of said legs and having a bottom portion attached to at least one of said vertically aligned holes in said vertical support of said leg, and at least a second support post substantially in alignment with a second of said legs and having a bottom portion attached to at least one of said vertically aligned holes in said vertical support of said second of said legs, said support posts are repositionable at any of said holes in said rear face of said stretcher for mounting different length overhead storage units at said tops of said support posts wherein one of said intermediate legs is attached to at least one of said support posts, each said support post having an upper end adapted to support a portion of the overhead storage unit above the worksurfaces, thereby permitting the incorporation of an overhead storage unit with a given worksurface of a different length.

3. The freestanding support system as set forth in claim 2 further comprising:

a plurality of work surfaces attached to said top horizontal supports of said legs, each of said worksurfaces having a top, a bottom, a first and a second end, and a rear edge.

4. The freestanding support system as set forth in claim 3 further comprising a plurality of gussets, each gusset intermediately attached between said stretcher and said upper portion of one of said rear edges of said legs affixing said stretcher to said legs.

5. The freestanding support system as set forth in claim 4 wherein:

at least one of said gussets is an end gusset which positions an outer side of one of said end legs substantially coplanar with an end of one of said worksurfaces.

6. The freestanding support system as set forth in claim 5 wherein:

at least one of said gussets is an intermediate gusset which positions at least one of said intermediate legs substantially centrally below an abutment of two of said worksurfaces, said at least on of said intermediate legs supporting at least a portion of each of said abutting two of said work surfaces.

7. The freestanding support system as set forth in claim 6 further comprising:

a plurality of post brackets, each post bracket intermediately attached between said bottom portion of one of said support posts and at least one of said vertically aligned holes in said rear edge of said vertical support of one of said legs.

8. The freestanding support system as set forth in claim 7 wherein:

at least one of said post brackets is an end post bracket which positions an outer edge of at least one of said support posts substantially coplanar with said outer side of one of said end legs and said end of said worksurface.

9. The freestanding support system as set forth in claim 7 wherein:

at least one of said post brackets is an intermediate post bracket which positions at least one of said support posts substantially in alignment with one of said intermediate legs.

10. The freestanding support system as set forth in claim 9 further comprising:

a plurality of modesty panels, each of said modesty panels attached to said rear surface of one of said stretchers substantially extending vertically from said top horizontal supports to above said feet of said legs, and substantially extending horizontally from a first of said legs supporting one end of one of said worksurfaces to a second of said legs supporting a second end of said one of said worksurfaces, each of said modesty panels substantially of an equal length as a length of said one of said worksurfaces.

11. The freestanding support system as set forth in claim 10 further comprising:

at least one privacy panel mounted to a top edge of one of said modesty panels and substantially coplanar with said modesty panel.

12. The freestanding support system as set forth in claim 11 wherein:

said rear edges of said worksurfaces in combination with front faces of said modesty panel, said privacy panel, and said support posts define a slot therebetween for routing office utility cables therealong in lay-in fashion.

13. The freestanding support system as set forth in claim 12 further comprising:

a plurality of cable troughs, each said trough attached to one of said stretchers for receiving therein office utility cables.

14. The freestanding support system as set forth in claim 13 further comprising:

at least one cable channel affixed to a rear of one of said legs for routing office utility cables from a building floor to at least one of said cable clips.

15. The freestanding support system as set forth in claim 12 wherein:

at least one of said legs is a pedestal storage unit.

16. The freestanding support system as set forth in claim 12 wherein:

said legs are vertically adjustable.

17. The freestanding support system as set forth in claim 11 wherein:

said support system is arranged to define a rectilinear office module having at least one side of said module open for ingress and egress of an office worker.

18. The freestanding support system as set forth in claim 17 further comprises:

a plurality of rectilinear office modules.

19. The freestanding support system as set forth in claim 18 wherein:

at least two of said rectilinear office modules have adjoining sides and further wherein said adjoining sides comprise abutting exterior faces of said modesty panels.

20. The freestanding support system as set forth in claim 19 in combination with a second office dividing system having dividing panels for the non-freestanding support of worksurfaces, overhead storage units and the like wherein:

said abutting exterior faces of said modesty panels of said adjoining office modules define a plurality of planes substantially coincident with a similar plurality of planes bisecting said office dividing panels of said second office dividing system defining a substantially identical office such that said adjoining office modules can be substituted for said office dividing panels while maintaining a substantially identical office layout on the building floor.

21. The freestanding support system as set forth in claim 20 wherein:

a thickness of said modesty panels is substantially one inch.

* * * * *